US006438767B1

(12) United States Patent
Warshawsky

(10) Patent No.: US 6,438,767 B1
(45) Date of Patent: Aug. 27, 2002

(54) ADJUSTABLE HEIGHT SHOWERHEAD

(75) Inventor: Jerome Warshawsky, Hewlett Harbor, NY (US)

(73) Assignee: I. W. Industries, Inc., Melville, NY (US)

( * ) Notice: Subject to any disclaimer, the term of this patent is extended or adjusted under 35 U.S.C. 154(b) by 0 days.

(21) Appl. No.: 09/843,513

(22) Filed: Apr. 26, 2001

(51) Int. Cl.[7] ..... A47K 3/20

(52) U.S. Cl. ..... 4/567; 4/615; 4/569; 4/570; 4/596

(58) Field of Search ..... 4/567, 568, 569, 4/570, 600, 599, 596, 615; 239/587.1, 279, 273, 282

(56) References Cited

U.S. PATENT DOCUMENTS 1,193,302 A * 8/1916 Seltner
1,360,381 A * 11/1920 Edwards
1,799,815 A * 4/1931 Hoff
1,986,355 A * 1/1935 Pajari
2,776,168 A * 1/1957 Schweda
3,564,621 A * 2/1971 Fletcher
4,991,458 A * 2/1991 Stuedemann
5,022,103 A * 6/1991 Faist
5,077,842 A * 1/1992 Horne, Jr.
5,632,049 A * 5/1997 Chen
5,741,101 A * 4/1998 Gulistan
5,976,183 A * 11/1999 Ritz
6,256,808 B1 * 7/2001 Graham et al.
6,276,004 B1 * 8/2001 Bertrand et al.

FOREIGN PATENT DOCUMENTS

GB 2223961 A * 3/1990

* cited by examiner

*Primary Examiner*—David J. Walczak
*Assistant Examiner*—Khoa D. Huynh
(74) *Attorney, Agent, or Firm*—Alfred M. Walker

(57) ABSTRACT

An adjustable height showerhead is slidably removable vertically along an axis to accommodate users of differing heights. The showerhead includes a fixed inner pipe, a water inlet connection, a wall mount and an adjustable pipe sleeve. The water inlet connection provides a flow of water into the fixed inner pipe, which has ports connected with the adjustable pipe sleeve to provide water therethrough into an annular space defined by the outer wall of the inner pipe and an inner wall of the adjustable pipe sleeve, which is connected to the outlet nozzle at a distal end. A locking subassembly maintains the showerhead in a fixed position until the locking assembly is unlocked, thereby permitting slidable movement of the adjustable pipe sleeve about an axis parallel to the fixed inner pipe.

10 Claims, 6 Drawing Sheets

ADJUSTABLE HEIGHT SHOWERHEAD

FIELD OF THE INVENTION

The present invention relates to height adjustable bathroom showerheads.

OBJECTS OF THE INVENTION

It is an object of the present invention to provide a showerhead which is adjustable in height for different users of a bathroom shower.

SUMMARY OF THE INVENTION

In keeping with these objects and others which may become apparent, the present invention includes an adjustable height showerhead fixture, which can be adjusted up and down; i.e. up for taller persons or down for children or handicapped persons who sit while showering.

This showerhead eliminates the uncomfortable crouching necessary of a tall person, and enables children, short persons or persons sitting down to be able to shower without having the water constantly on the top of the user's head.

Water is moved through a movable conduit that travels up or down along a vertical axis. The movable conduit is loosened by a bottom twist member, but other loosening members could be used, such as activated by a lever, handle, etc.

BRIEF DESCRIPTION OF THE DRAWINGS

The present invention can best be understood in connection with the accompanying drawings, in which.

DETAILED DESCRIPTION OF THE INVENTION

Figure 1:
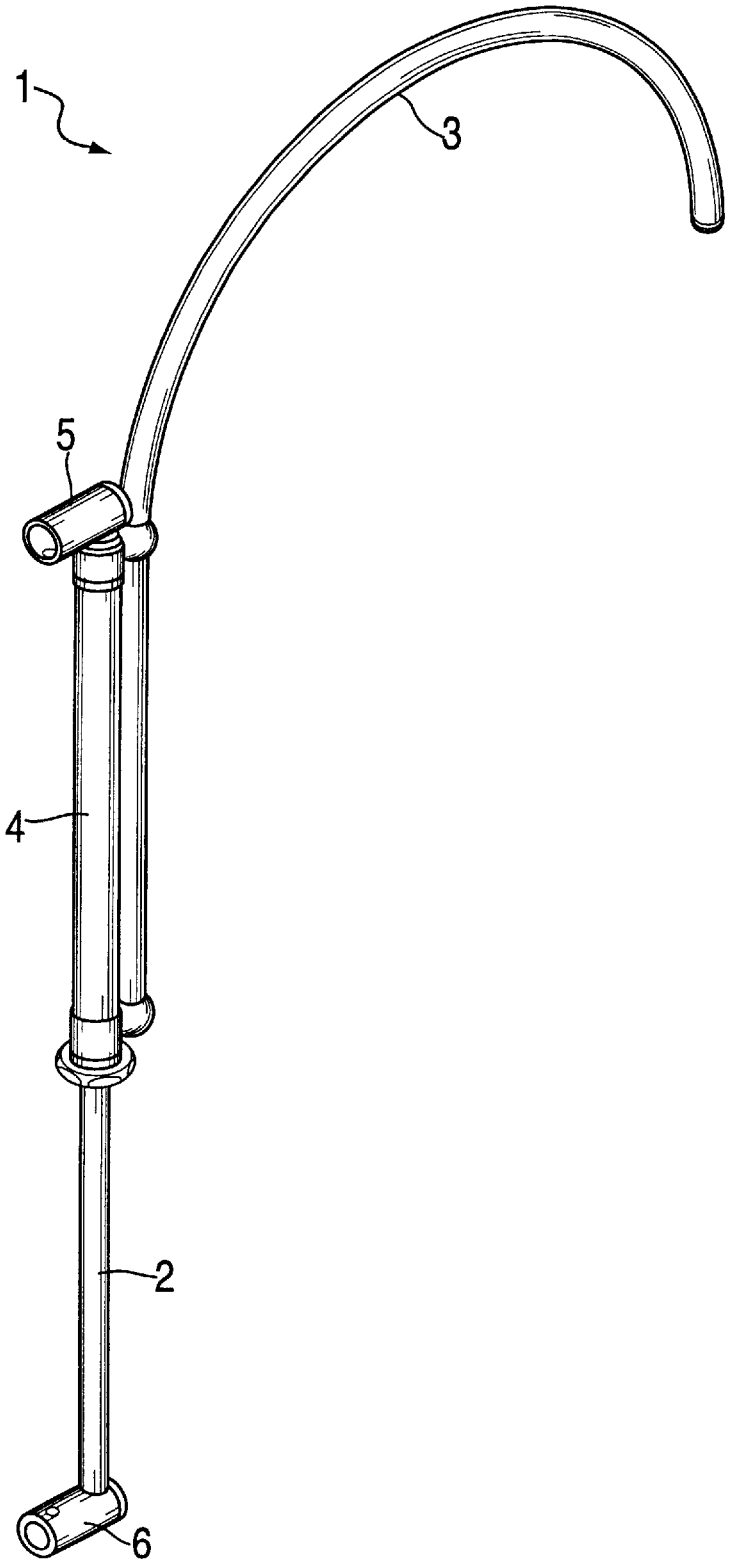
FIG. 1 is a perspective view of an adjustable height showerhead unit of the present invention.

FIG. 1 shows the adjustable height showerhead 1 of the present invention (the actual showerhead nozzle is not shown in this view). The major parts are the fixed inner pipe 2, water inlet connection 5, bottom wall mount 6, adjustable pipe sleeve 4 and outlet pipe 3. Outlet pipe 3 is shown in FIG. 1 with a first proximal straight portion and a curved distal outlet portion. However, outlet 3 can have other geometric configurations, such as angled, flat-topped, etc.

It is noted that FIG. 1 is illustrative only, since a water inlet connection could be provided where bottom wall mount 6 is shown and a top wall mount could be provided where water inlet connection 5 is shown.

Figure 2:
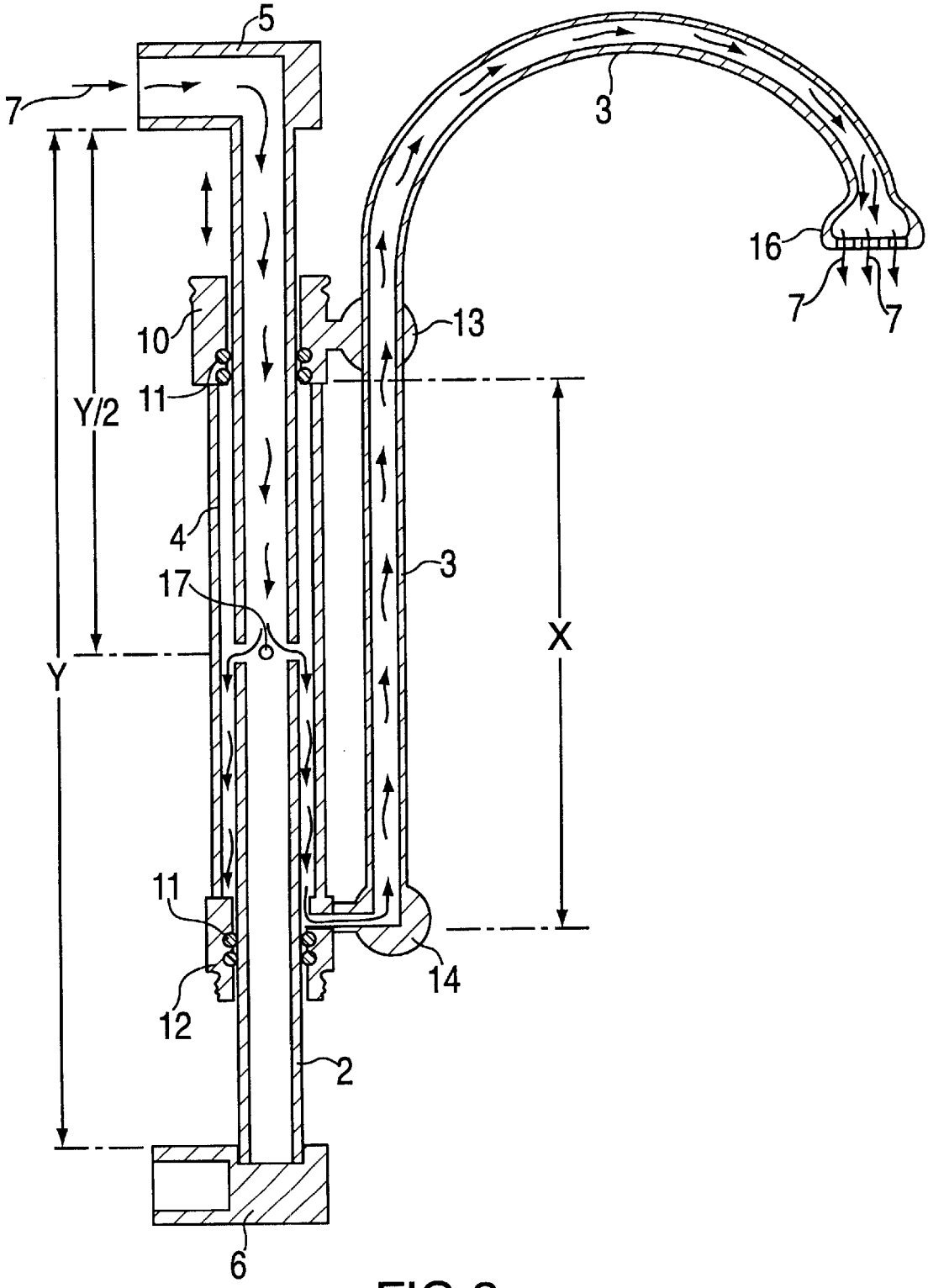
FIG. 2 is a side central cross sectional view of the unit as in FIG. 1 showing the water flow pattern.

The cross section of FIG. 2 shows the mechanism and plumbing of the invention along with the water flow. Water flow throughout the unit is indicated by short arrows 7. Water preferably enters through inlet connection 5 at the top and flows into fixed inner pipe 2 and exits half way down through one or more radial holes 17 (typically four) into the annular space defined by the outer wall of inner pipe 2 and the inner wall of pipe sleeve 4. Water flow 7 continues to bottom sealing fitting 12 and through a side orifice into coupling 14, such as a spherical support and coupling, and further into a straight portion of outlet pipe 3. The straight portion of outlet pipe 3 is spaced apart from, and parallel to, pipe sleeve 4. Flow 7 continues through a curved portion of outlet pipe 3 and exits through showerhead nozzle 16. Water is retained under pressure in the annular space between pipe 2 and sleeve 4 by virtue of one or more O-rings 11, such as dual pairs of elastomeric O-rings 11, which are located in respective in internal grooves in top sealing fitting 10 and bottom sealing fitting 12.

Top sealing fitting 10 is attached to side support 13, preferably spherical, which supports outlet pipe 3. It can be appreciated that the entire subassembly including adjustable pipe sleeve 4 with fittings 10 and 12 along with outlet piping 3, including showerhead 16, is slidably adjustable along fixed pipe 2 while maintaining the integrity of the water seal provided by the O-rings 11.

Figure 7:
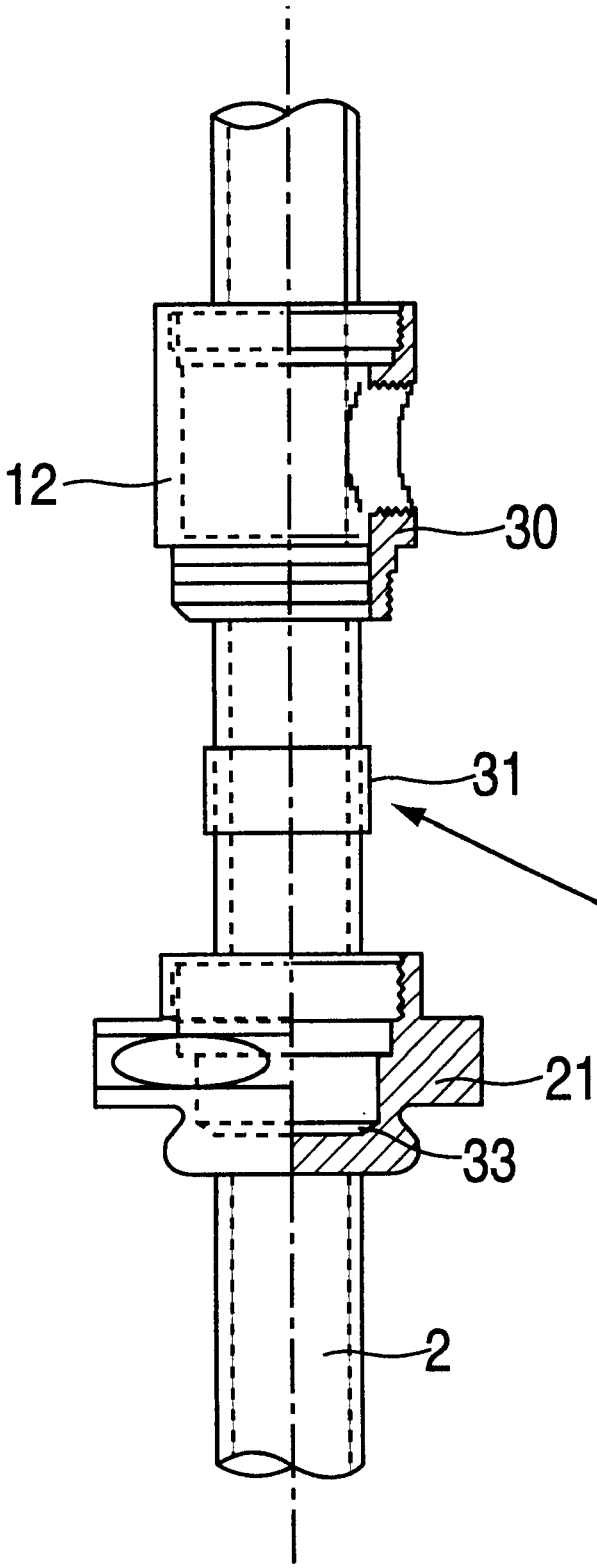
FIG. 7 is a side elevation view in partial cross section showing a close-up detail of the adjustment locking feature of the unit of the present invention.

The details of a locking mechanism to maintain a particular height adjustment are shown in FIG. 7 (they are omitted from this view of FIG. 2 for clarity). To maintain water seal integrity, dimension "X" in FIG. 2 should be equal to or greater than dimension "Y/2" minus the height of the top 10 or bottom 12 nipple.

Figure 3:
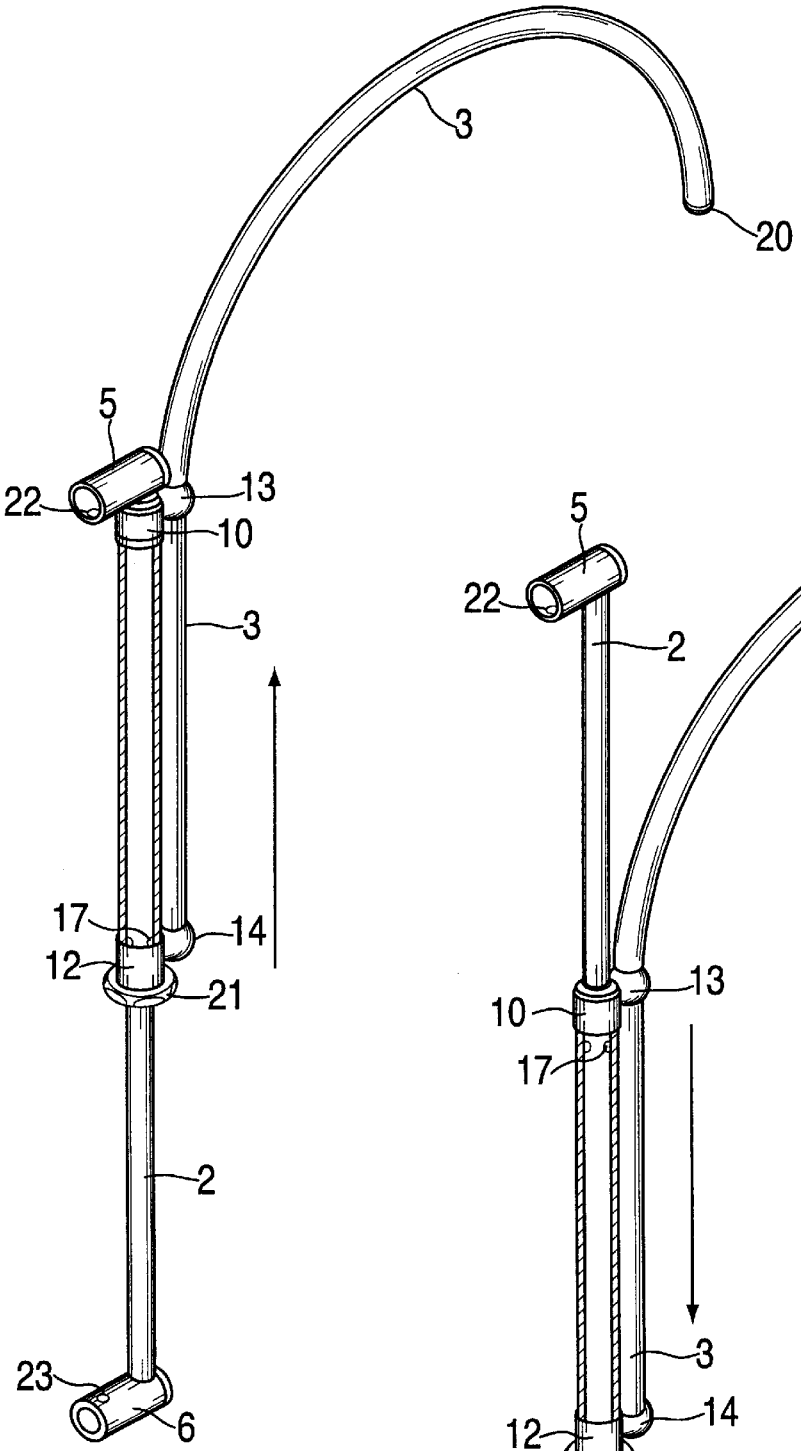
FIG. 3 is a perspective view with a partial cutaway of the unit as in FIG. 1 in the uppermost position.
Figure 4:
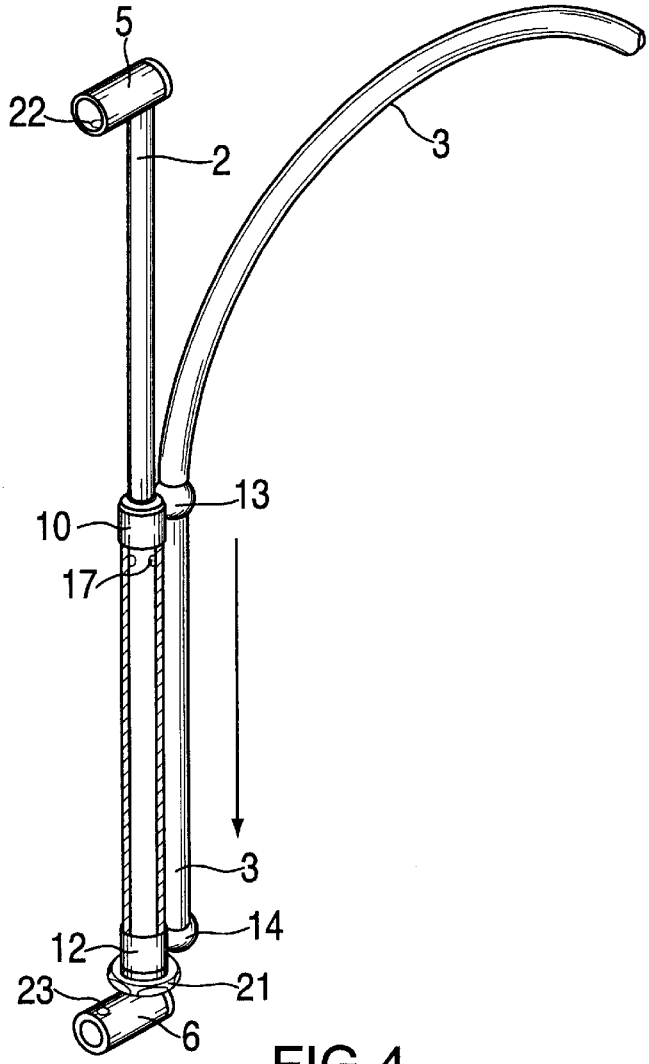
FIG. 4 is a perspective view with a partial cutaway of the unit in the extreme lower position.

This is more easily understood by viewing FIGS. 3 and 4 which show the upper extreme and lowest extreme position respectively. The upwardly pointing arrow in FIG. 3 shows the vertically ascending movement of adjustable pipe sleeve 4, and the downwardly pointing arrow in FIG. 4 shows the vertically descending movement of adjustable pipe sleeve 4.

Other details shown in these two FIGS. 3 and 4 include threaded set screw holes 22 and 23 in water inlet connection 5 and bottom wall mount 6 respectively, and twisting lock nut 21. In a typical implementation, the vertical adjustment range is preferably about 10.5" (or 27 cm).

Figure 6:
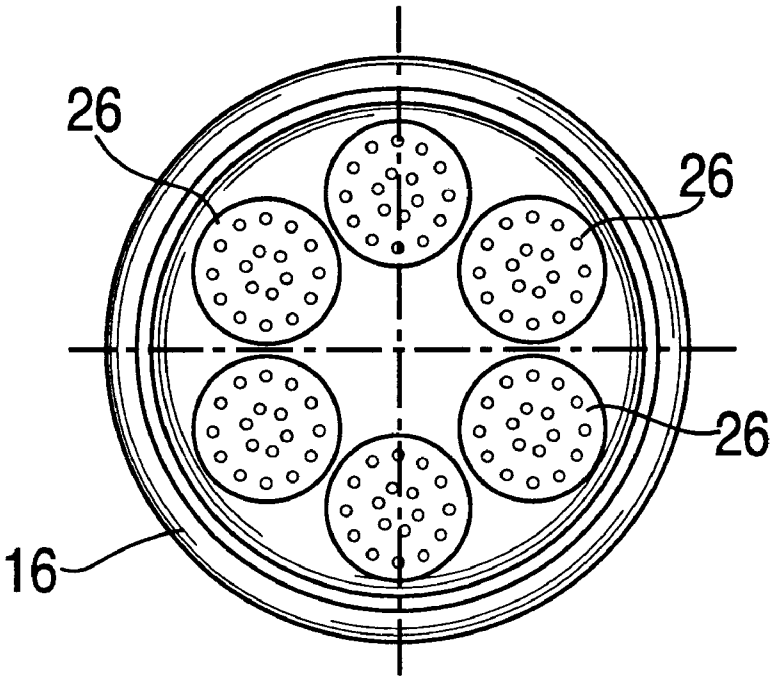
FIG. 6 is a bottom view of the typical conventional showerhead nozzle as in FIG. 5.
Figure 5:
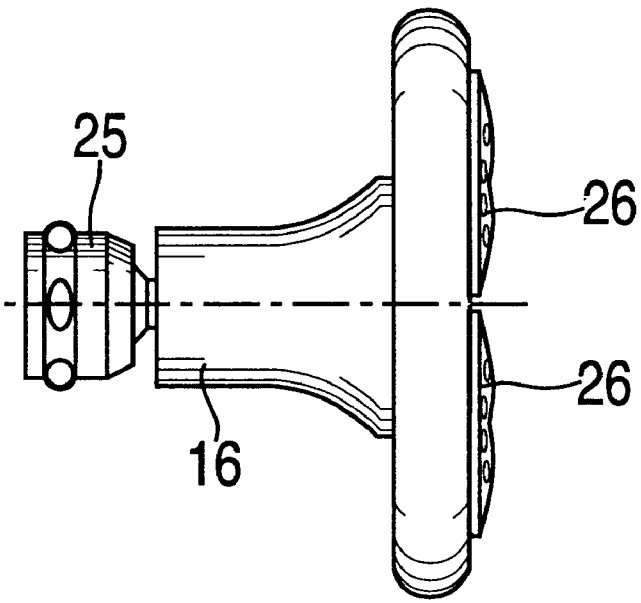
FIG. 5 is a side elevational view of a typical conventional showerhead nozzle used with the unit of the present invention.

FIGS. 5 and 6 are two views of a typical conventional showerhead nozzle 16 which is threaded onto the external threads on the distal end of curved outlet pipe 3. Other configurations may be used for the nozzle (not shown). The internal threads are in ball joint collar 25. Perforated outlet orifices 26 break up the flow into a spray or fine streams.

FIG. 7 shows the detail of the locking subassembly, which includes lock nut 21 and flexible sleeve 31, made typically of plastic, such as sold under the tradename DELRIN, for example. Lock nut 21 has recess 33 with slightly tapered sides such that it compresses plastic sleeve 31 against fixed pipe 2 to provide a clamping action which prevents movement of the movable subassembly, when nut 21 is rotated so as to further engage the external threads on the distal end of bottom fitting 12.

Figure 8:
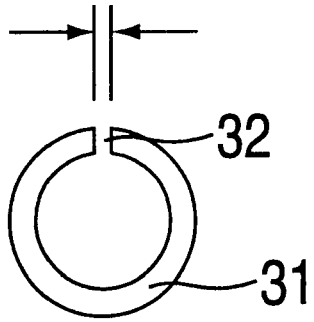
FIG. 8 is a top plan view of the split collar of the unit of the present invention; and, FIG. 9 is a side central cross sectional view of the water inlet detail of the unit of the present invention.

FIG. 8 is a top view of sleeve 31 showing gap 32 which permits compression against pipe 2.

While shown in FIG. 7 as a hand operated nut, lock nut 21 can be optionally formed into a collar with a pivoted handle (not shown) which permits locking and unlocking with less force due to the leverage thus provided.

Figure 9:
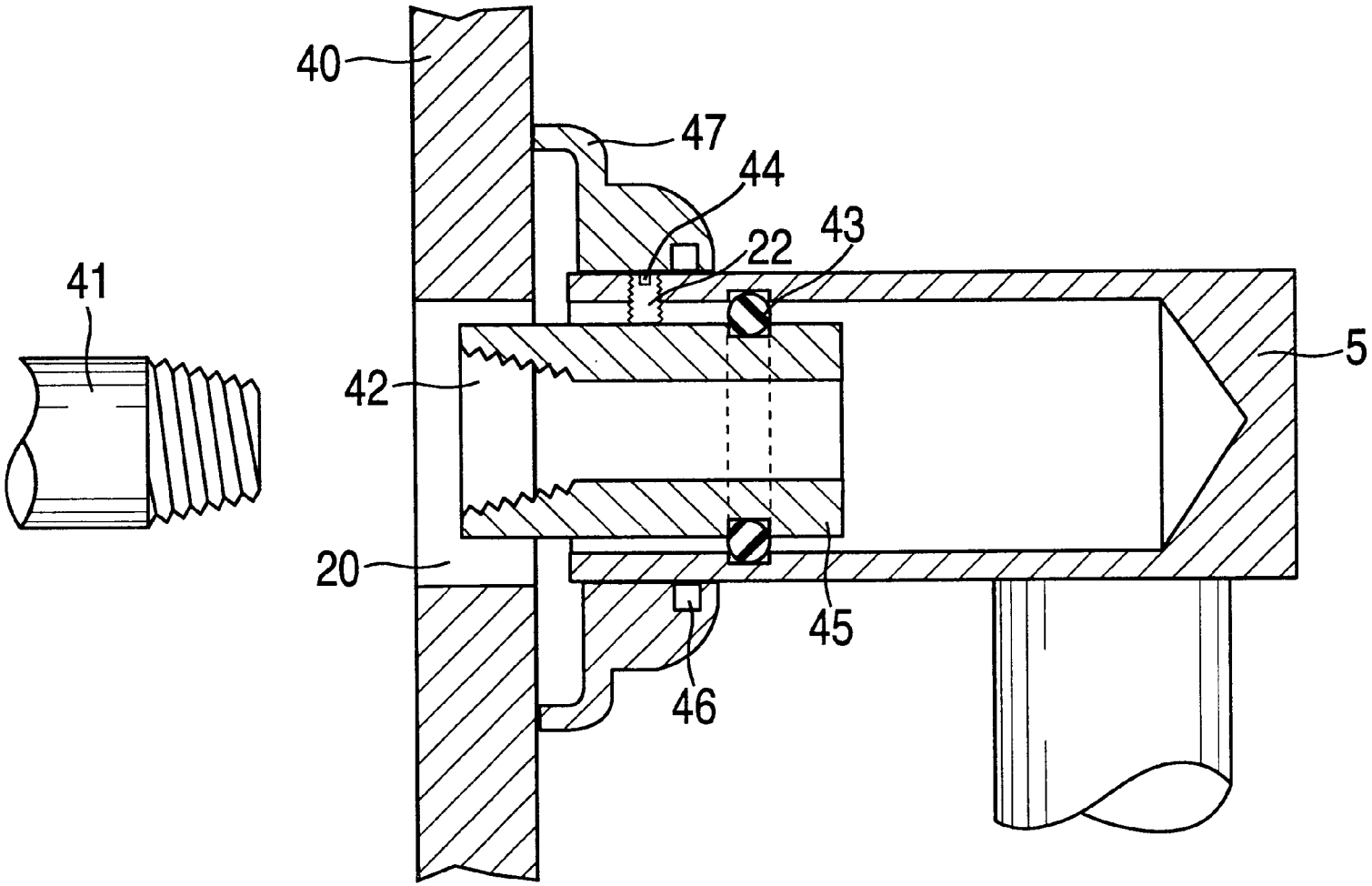

FIG. 9 is a detail showing the attachment of the water inlet 5 at a wall 40. The water supply pipe 41 supplied by the plumber has external threads on its end which mate with internal pipe threads 42 on a short coupling nipple 45. Nipple 45 has a groove retaining O-ring 43 which forms a coupling seal to water inlet 5. After the connection is made, inlet 5 is mechanically attached to nipple 45 by a fastener, such as set screw 44, which is shown threaded into set screw hole 22. Prior to wall attachment, decorative escutcheon 47 is slipped over water inlet 5 and moved toward pipe 2 to facilitate the installation without interference. After set screw 44 is tightened, escutcheon 47 is moved toward the wall 40, and is guided by O-ring 46 so as to hide set screw hole 22 and provide a finished attractive appearance against wall 40. The attachment of bottom wall mount 6 over a protruding (non-plumbed) pipe nipple as a structural support using a set screw and escutcheon is similar.

It is further noted that other modifications may be made to the present invention without departing from the scope of the invention, as noted in the appended claims.

I claim:

1. An adjustable height showerhead comprising:

a fixed inner pipe connected to a water inlet connection, said fixed inner pipe mounted to a wall mount, an adjustably movable pipe sleeve having a straight portion connected to an outlet pipe, said adjustably movable pipe sleeve having a top sealing fitting and a bottom sealing fitting, said straight portion extending between said top sealing fitting and said bottom sealing fitting, said straight portion further includes a water outlet located at said bottom sealing fitting, said water inlet connection providing a flow of water through said water inlet connection into said fixed inner pipe, said fixed inner pipe having at least one hole permitting flow of water into an annular space defined by an outer wall of said fixed inner pipe and an inner wall of said straight portion of said adjustably movable pipe sleeve, said adjustably movable pipe sleeve having a coupling connecting said water outlet of said straight portion to a proximal end of said outlet pipe, said outlet pipe having a showerhead nozzle attached to a distal end of said outlet pipe, and said adjustably movable pipe sleeve slides longitudinally along an axis parallel to a straight portion of said fixed inner pipe.

2. The adjustable height showerhead as in claim 1 wherein water is retained under pressure in said annular space between said fixed pipe and said adjustable sleeve by at least one seal.

3. The adjustable height showerhead as in claim 1 wherein said at least one seal comprises at least one elastomeric O-ring in an internal groove in the top sealing fitting and at least one elastomeric O-ring in the bottom sealing fitting.

4. The adjustable height showerhead as in claim 3 wherein said top sealing fitting is attached to a support which supports said outlet pipe at one end and said bottom sealing fitting is attached to said coupling which supports said outlet pipe at another end thereof.

5. The adjustable height showerhead as in claim 4 wherein said adjustably movable pipe sleeve, said fittings and said outlet pipe including said nozzle are slidably adjustable along said fixed inner pipe.

6. The adjustable height showerhead as in claim 4 wherein said water inlet connection includes a further pipe having external threads on its end which mate with internal pipe threads on a coupling nipple, said coupling nipple having a groove retaining an O-ring forming a coupling seal between said nipple and said water inlet connection, wherein after fluid connection is made, said water inlet connection is mechanically attached to said nipple.

7. The adjustable height showerhead as in claim 6 further comprising an escutcheon engagable over said water inlet connection.

8. The adjustable height showerhead as in claim 1 further including a locking subassembly including a lock nut engagable about a deformable sleeve, wherein said lock nut has a recess with tapered sides, wherein said lock nut compresses said sleeve against said fixed pipe to provide a clamping action preventing movement of said adjustable pipe sleeve, said outlet pipe and said nozzle when said lock nut is rotated about said fixed inner pipe.

9. The adjustable height showerhead as in claim 8 wherein said deformable sleeve displays a gap, permitting compression of said deformable sleeve against said adjustably movable pipe sleeve when said deformable sleeve is compressed by said lock nut.

10. The adjustable height showerhead as in claim 9 wherein said lock nut is a manually rotatable nut.

* * * * *